US009888733B2

(12) United States Patent
Hull

(10) Patent No.: US 9,888,733 B2
(45) Date of Patent: Feb. 13, 2018

(54) PROTECTIVE DEVICE FOR USE WITH A GLOVE

(71) Applicant: Summit Glove Inc., Minerva, OH (US)

(72) Inventor: James L. Hull, Malvern, OH (US)

(73) Assignee: Summit Glove Inc., Minerva, OH (US)

( * ) Notice: Subject to any disclaimer, the term of this patent is extended or adjusted under 35 U.S.C. 154(b) by 190 days.

(21) Appl. No.: 14/624,047

(22) Filed: Feb. 17, 2015

(65) Prior Publication Data

US 2015/0164159 A1 Jun. 18, 2015

Related U.S. Application Data

(63) Continuation-in-part of application No. 13/947,423, filed on Jul. 22, 2013.

(51) Int. Cl.
*A41D 19/015* (2006.01)
*A41D 13/08* (2006.01)

(52) U.S. Cl.
CPC ..... *A41D 19/01529* (2013.01); *A41D 13/081* (2013.01); *A41D 19/01594* (2013.01)

(58) Field of Classification Search
CPC ..... A41D 19/01529; A41D 13/081; A41D 19/01594; A41D 13/087; A41D 19/0096; A41D 19/01505; A41D 19/01511; A41D 19/01588
USPC ..... 2/167, 16, 163, 164
See application file for complete search history.

(56) References Cited

U.S. PATENT DOCUMENTS 1,483,595 A 2/1924 Read
1,673,517 A 6/1928 Kurz
2,040,137 A 5/1936 Jensen
2,067,790 A 1/1937 Sager
2,582,240 A 1/1952 Dumas
4,032,990 A * 7/1977 Mandlman ..... A41D 19/01529 2/16
4,454,611 A * 6/1984 Tschirch ..... A41D 19/01529 2/16
4,524,464 A 6/1985 Primiano et al.
4,658,441 A 4/1987 Smith
4,742,578 A 5/1988 Seid
4,779,290 A 10/1988 Welch et al.
4,785,479 A 11/1988 Watanabe
4,833,733 A 5/1989 Welch et al.
4,873,998 A 10/1989 Joyner
4,894,866 A 1/1990 Walker
4,942,626 A 7/1990 Stern et al.
4,987,611 A 1/1991 Maye
5,070,540 A * 12/1991 Bettcher ..... A41D 19/0058 156/165

(Continued)

OTHER PUBLICATIONS http://www.skis.com/Kombi-Glove-Protector---Kids-2013/11302P,default,pd.html—Kombi Glove Protector—Kids (online ski shop)—date printed: Apr. 16, 2013.

*Primary Examiner* — Alissa L Hoey
(74) *Attorney, Agent, or Firm* — Sand & Sebolt

(57) ABSTRACT

A protective device for use in a high temperature and liquid environment provides a glove integrally formed with a protective member in the thumb webbing region. The protective member is not readily detectable when viewing the outside of the glove. The protective member is cut resistant and constructed to protect a workman's hand as a sharp and hot object passes over the protective member contacting the outer surface of the glove.

15 Claims, 5 Drawing Sheets

(56) References Cited

U.S. PATENT DOCUMENTS 5,168,578 A 12/1992 Stanley
5,187,815 A 2/1993 Stern et al.
5,231,700 A 8/1993 Cutshall
5,345,608 A 9/1994 Mergens et al.
5,384,083 A * 1/1995 Dawn ..... A41D 19/01558 264/130
5,402,536 A 4/1995 Matthews
5,561,856 A 10/1996 Pesco
5,564,127 A * 10/1996 Manne ..... A41D 19/0058 2/161.7
5,588,651 A 12/1996 Frost
5,604,934 A * 2/1997 Willett ..... A41D 19/01547 2/161.1
D389,608 S 1/1998 Kraatz
5,745,919 A 5/1998 Kraatz
5,770,297 A 6/1998 Grubich
6,145,128 A 11/2000 Suzuki
6,260,203 B1 * 7/2001 Battle ..... A41D 19/01529 2/16
6,427,246 B1 8/2002 Doi et al.
6,449,772 B1 9/2002 Donner
6,457,182 B1 10/2002 Szczesuil et al.
6,539,552 B1 * 4/2003 Yoshida ..... A41D 19/04 2/161.6
6,721,960 B1 * 4/2004 Levesque ..... A41D 19/01523 2/16
6,760,924 B2 7/2004 Hatch et al.
7,021,204 B2 4/2006 Backus et al.
7,089,600 B2 8/2006 Morita
7,377,566 B2 5/2008 Gazaui et al.
7,380,288 B1 * 6/2008 Duncan ..... A41D 19/01529 2/161.6
7,383,590 B1 6/2008 Duncan
7,431,671 B1 10/2008 Frost
7,469,426 B2 12/2008 Roeckl
7,836,839 B2 * 11/2010 Park ..... A41D 19/00 112/475.09
7,963,864 B2 6/2011 Frost
8,656,518 B2 * 2/2014 Saunders ..... A41D 19/0096 2/161.6
8,852,033 B1 10/2014 Frost
8,863,317 B2 * 10/2014 Tsuru ..... A41D 19/015 2/161.1
9,549,579 B2 * 1/2017 Bailey ..... A63B 71/146
2003/0079273 A1 * 5/2003 Genkins ..... A41D 19/01529 2/161.6
2003/0134063 A1 * 7/2003 Vance ..... A41D 19/0096 428/35.7
2003/0140396 A1 7/2003 Vero et al.
2005/0005338 A1 1/2005 Lewis
2006/0090771 A1 5/2006 Ramet
2006/0150299 A1 7/2006 Geng
2007/0083980 A1 4/2007 Yang et al.
2008/0120754 A1 * 5/2008 Raymond ..... A41D 19/01558 2/16
2009/0077704 A1 3/2009 Duncan et al.
2009/0139011 A1 * 6/2009 VanErmen ..... A41D 19/01505 2/161.8
2009/0158486 A1 6/2009 Cote et al.
2009/0271905 A1 11/2009 Alexander
2010/0095428 A1 * 4/2010 Fisher ..... A41D 19/01558 2/161.1
2010/0186144 A1 * 7/2010 Zhu ..... A41D 19/01511 2/167
2010/0186457 A1 7/2010 Zhu
2010/0325779 A1 * 12/2010 Matsunobu ..... B29C 41/14 2/167
2011/0145967 A1 6/2011 Hull
2011/0289652 A1 12/2011 Thompson et al.
2012/0227158 A1 * 9/2012 Ashworth ..... A41D 19/015 2/164
2012/0278964 A1 11/2012 Bormann-Early
2013/0180022 A1 7/2013 Baungartger
2013/0219588 A1 * 8/2013 Nakagawa ..... A41D 19/0065 2/168
2013/0254964 A1 10/2013 Robinson
2013/0319055 A1 * 12/2013 Tatsumi ..... D02G 3/322 66/174
2014/0137304 A1 5/2014 Katz
2015/0020284 A1 * 1/2015 Hull ..... A41D 19/01594 2/16
2015/0164159 A1 6/2015 Hull
2016/0029712 A1 * 2/2016 Hull ..... A41D 19/01529 2/16
2016/0192721 A1 * 7/2016 Kishihara ..... A41D 19/01558 2/159
2016/0235138 A1 * 8/2016 Smith ..... A41D 19/01505

* cited by examiner

PROTECTIVE DEVICE FOR USE WITH A GLOVE

CLAIM OF PRIORITY

The present application is a continuation in part application of U.S. patent application Ser. No. 13/947,423, filed on Jul. 22, 2013, and claims priority thereto, the entirety of which is incorporated herein as if fully rewritten.

BACKGROUND OF THE INVENTION

1. Technical Field

The present invention relates generally to protective coverings. More particularly, the present invention relates to protective coverings used as a glove for a hand. Specifically, the present invention provides a protective device to cover the webbing region located between a thumb and index finger on a liquid proof heat resistant glove or mitten.

2. Background Information

Humans have enjoyed roasting chickens on a rotisserie since at least the middle ages. Modern rotisserie devices are provided in the form of ovens, often at supermarkets or grocery stores. The chickens cook on a rotisserie spit that rotates in the oven. The spit is extremely sharp as it has to pierce the chicken so the chicken may be affixed to the spit while it rotates in the oven. The rotisserie oven heats up to high temperatures, often in excess of 500 degrees, and cooks the chicken.

Liquid proof heat resistant gloves are often used in commercial settings, such as delicatessens that cook their own rotisserie chickens. These gloves are designed to protect a worker's hands from the high heat, and hot liquids (e.g., grease) that are associated with the rotisserie roasting of chicken. A deli worker dons these gloves prior to removing the chickens from the spit. To remove a chicken from a spit, a worker wearing the liquid proof heat resistant gloves removes the spit from the rotating oven. The worker then grasps the spit at one end. Ordinarily, a right handed person grasps the right end of the spit with his right hand and grasps adjacent the right end of the spit with his left hand in the glove. The user then pulls the spit using his right hand in a motion similar to drawing a sword, all while continuing to grasp the spit with his left hand. As the spit travels through the user's grasped hand, the chickens are released from the spit and fall into a desired container. A problem often arises when the worker removes the chickens because drawing the spit through the grasped glove has a tendency to cut the glove surface. The liquid proof heat resistant gloves often cost around one hundred dollars a pair and currently some delicatessens are replacing cut or damaged gloves every three days.

A search for prior art revealed a protector for a ski glove. One exemplary ski glove protector is manufactured by Kombi, Ltd. of Essex Junction, Vt., USA and sold commercially under the name of "Glove Protector" available at www.skis.com. This Kombi glove protector is constructed of natural leather and is for use with ski gloves to protect a cold weather ski glove from being torn by ski tow ropes while a wearer grasps the tow rope. This Kombi glove protector is cold weather outdoor gear and would not function in the protective manner at the high temperatures required for protecting a liquid proof heat resistant glove donned by a deli worker. The leather constructed Kombi glove would melt at the high temperatures ranges in which the present invention operates.

SUMMARY

Thus, while the liquid proof heat resistant gloves exist for protecting the deli worker from the hot spit and hot liquids, a need exists to protect the expensive glove from the slicing motion of the spit as it pulled through the grasped hand of the deli worker.

In one aspect, an exemplary embodiment of one aspect may provide a liquid proof and heat resistant protective device worn on a hand comprising: a finger receiving first sleeve; a thumb receiving second sleeve; a thumb webbing region between the first and second sleeve; and an integral protective member in the thumb webbing region formed of a material different than the first and second sleeves.

In another aspect, an embodiment of one aspect may provide a method of forming a hand protecting device with an integrally formed protective member covering a thumb webbing region comprising the steps of: attaching a protective member to a liner in a thumb webbing region defined between a finger receiving first sleeve and a thumb receiving second sleeve; and coating the protective member with a liquid that cures to an outer surface that is liquid proof and heat resistant liquid.

In yet another aspect, an embodiment of one aspect may provide a protective device for use in a high temperature and liquid environment in the configuration of a glove integrally formed with a protective member in the thumb webbing region. The protective member is not readily visually detectable when viewing the outside of the glove. The protective member is cut resistant and constructed to protect a workman's hand as a sharp and hot object passes over the protective member contacting the outer surface of the glove.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Initially, the Inventors note that the present invention is a continuation-in-part application of U.S. patent application Ser. No. 13/947,423 (the '423 Application) filed on Jul. 22, 2013, the entirety of which is fully incorporated herein as if fully re-written. The present invention touches upon additional subject matter to the aforementioned '423 Application, namely, liquid proof and heat resistant gloves that include integrally formed protective members in, on, along, or extending over the thumb crotch or thumb webbing region of the glove. Since this is a continuation-in-part application of the '423 Application, some similar structural nomenclature is used herein when referencing some portions of the glove. However, there may be some instances where structural nomenclature differs between similar elements and there may be other instances where nomenclature is similar between distinct elements relative to this application and the '423 Application.

Figure 1:
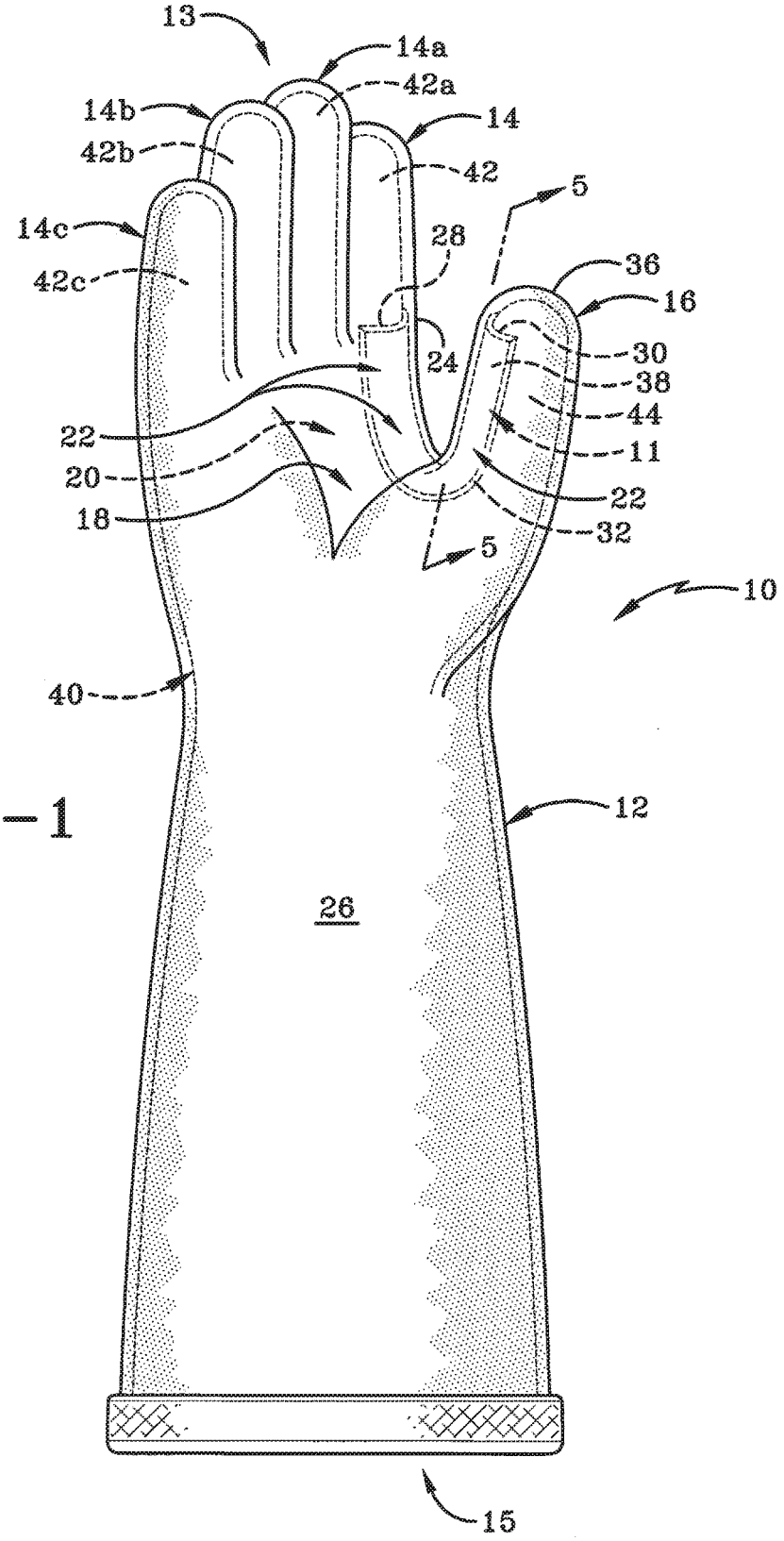
FIG. 1 is a view of a palm side of the protective device of the present invention.

As depicted in FIG. 1, a liquid proof and heat resistant protective device 10 worn on a hand comprises: a finger receiving first sleeve 14; a thumb receiving second sleeve 16; a thumb webbing region 22 between the first and second sleeve; and an integral protective member 11 in the thumb webbing region 22 formed of a material different than the first and second sleeves 14, 16.

Protective device 10 includes a glove 12 having a top end 13 located adjacent the tip of the fingers and a bottom end 15 located adjacent or below the wrist. Bottom end 15 defines a glove opening through which a person's hand may be inserted into the glove and be removed therethrough. Glove 12 may also have sheaths or sleeves respectively covering the remaining fingers (14*a*, 14*b*, 14*c*), or glove 12 may be configured as a mitten having only a thumb sheath and a four finger sheath covering the remaining fingers. Index finger portion 14 receives at least the index finger of a human hand. Thumb portion 16 receives the thumb of a human hand. Glove 12 has a front or palmar region 18 and a back or dorsal region 20 opposite palmar region 18. Palmar region 18 lies along the palm of a user's hand when glove 12 is worn. Dorsal region 20 lies along the back of a user's hand when glove 12 is worn. Glove 12 defines a J-shaped thumb webbing region or crotch 22 between index finger portion 14 and thumb portion 16. When viewed from the palmar side of a left hand glove or viewed form the dorsal side of a right hand glove, webbing region 22 is J-shaped. Thumb webbing region 22 begins adjacent and below the base 24 of index finger portion 14 and extends to the of thumb portion 16. Webbing region 22 extends partially around the hand from front 18 to back 20 crossing between the index finger portion 14 and thumb portion 16. In general, the embodiments of the protective device 10 engage and protect the thumb webbing region 22 of glove 12 when device 10 is in a mounted position.

Protective member 11 is integral to glove 12 defining protective device 10. Protective member 11 lies beneath an outer surface or skin 26 of glove 12 on protective device 10. In one embodiment, member 11 lies entirely beneath outer surface 26 wherein no portion of protective member 11 is viewable when looking at protective device 10. However, member 11 may still be detectable to the touch inasmuch as member 11 below skin 26 may cause the portion occupied by member 11 to be raised relative to other portions of the glove. Outer surface or skin 26 is generally continuous but may include slight gradations adapted to form a grip. One exemplary process of constructing and forming outer surface 26 is described in commonly owned U.S. Patent App. Pub. No. 2011/0145967, the disclosure of which is incorporated herein by reference as if fully re-written.

Protective member 11 is constructed from a material selected from a group comprising a para-aramid synthetic fiber and an aramid synthetic fiber. In one exemplary embodiment, protective member 11 is constructed from Kevlat®, which is a para-aramid synthetic fiber. The Kevlar portion or layer 9 of protective member 11 is represented by reference numeral 9. Protective member 11 is cut resistant and able to withstand deformation when exposed or slicing forces. The cut resistant protective member 11 assists in shielding the webbing region of a workman's hand inside the glove.

Protective member 11 includes a first end 28 spaced opposite a second end 30. A first side 32 extends from first end 28 to second end 30 and a second side 34 extends similarly from end to end opposite first side 32. In the shown embodiment of FIG. 1, first end 28 of the protective member 11 is adjacent the base 24 of the first sleeve 14, Second end 30 of the protective member 11 is disposed between the base and a tip end 36 of the second sleeve 16. In the shown embodiment, the second end 30 of the protective member 11 is closely adjacent the tip end 36 of the second sleeve 16. Furthermore, second end 30 is above a base of thumb second sleeve 16.

First edge 32 on protective member 11 is disposed in the palmar region 18 and the second edge 34 is disposed in the back or dorsal region 20. In one embodiment, protective member 11 partially occupies the palmar region 18 such that first edge 32 is closely adjacent the thumb webbing region 22, as depicted in FIG. 1. Other exemplary embodiments may provide protective member 11 substantially covering the palmar region 18 such that first edge 32 is below any one of the sleeves 14*a*, 14*b*, or 14*c*.

Figure 2:
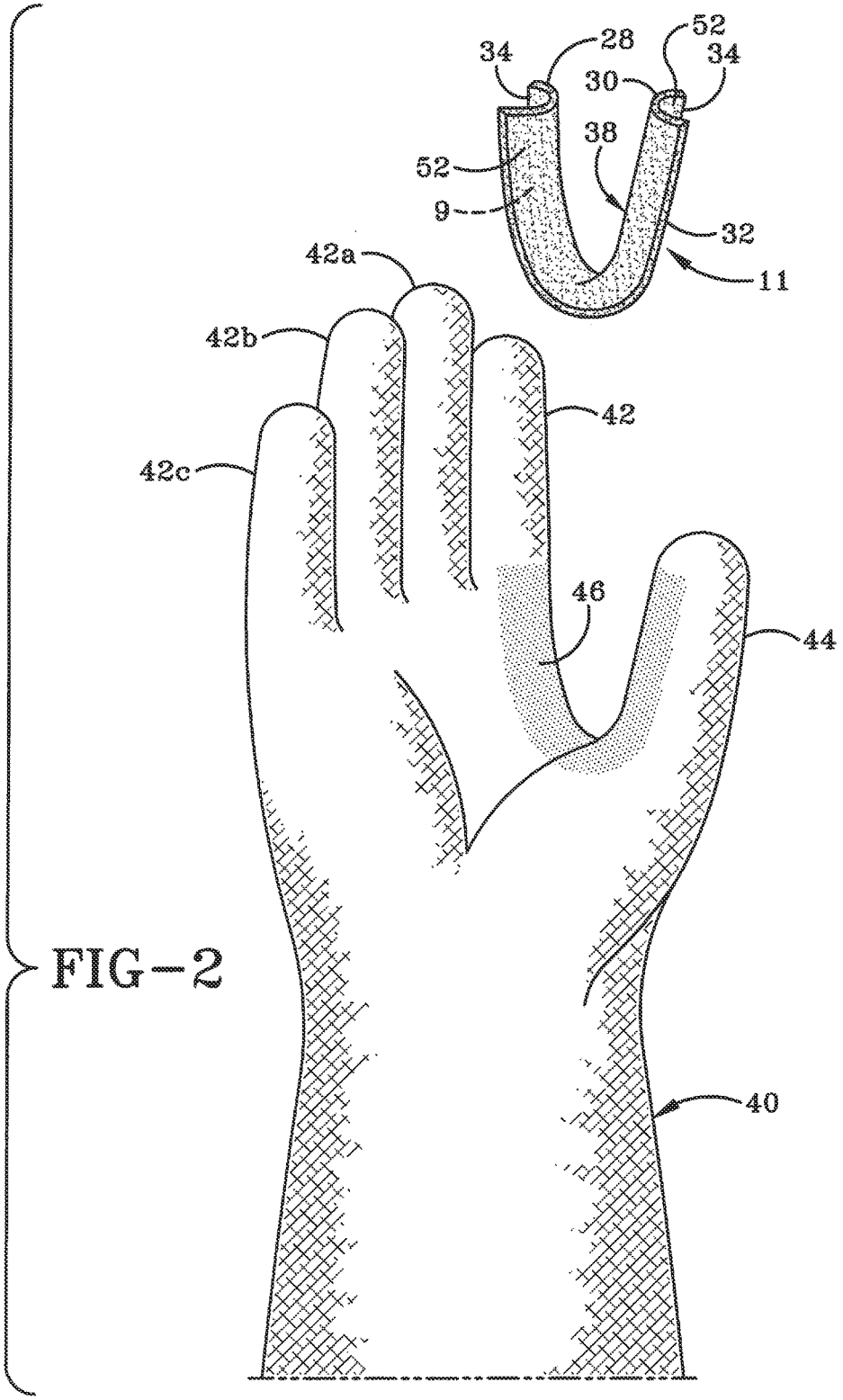
FIG. 2 is an exploded view of a protective member and liner.

As depicted in FIG. 2, protective member 11 is a generally U-shaped configuration when viewed from the side. U-shaped protective member 11 is semi-flexible prior to integral formation with glove 12 to create protective device 10. When formed in a U-shaped configuration, protective member 11 includes an arcuate surface 38 over the thumb webbing region 22. Arcuate surface 38 defines a C-shaped cross section of protective member 11 since arcuate surface 38 extends from palmar region 18 over webbing region 22 to dorsal region 20. A first sleeve, which may also be referred to as an index finger sleeve 42, includes a base opposite a tip. A first end of the protective member 11 is positioned above the inner liner 40 adjacent the base of the first sleeve 42. The first end of the protective member 11 is a C-shaped cross section to allow the first end of the protective member 11 to partially wrap around the inner liner 40 in the first sleeve 42. A second end of the protective member 11 is positioned above the inner liner 40 and is disposed between the base and tip end of a second sleeve 44. The second end of the protective member 11 is a C-shaped cross section so as to allow the second end of the protective member 11 to partially wrap around the inner liner 40 in the second sleeve 44.

With continued reference to FIG. 2, protective device 10 further includes a liner 40 comprising an index finger sleeve 42 shaped complementary to sleeve 14, a thumb sleeve 44 shaped complementary to sleeve 16, and sleeves 42*a*, 42*b*, and 42*c* shaped complementary to 14*a*, 14*b*, and 14*c*, respectively. Liner 40 includes a thumb webbing region between sleeves 42 and 44 similar to thumb webbing region 22. An adhesive 46 attaches protective member 11 to liner 40 in the thumb webbing region (See FIG. 3). In one exemplary embodiment, liner 40 is constructed from drilled cotton.

Figure 4:
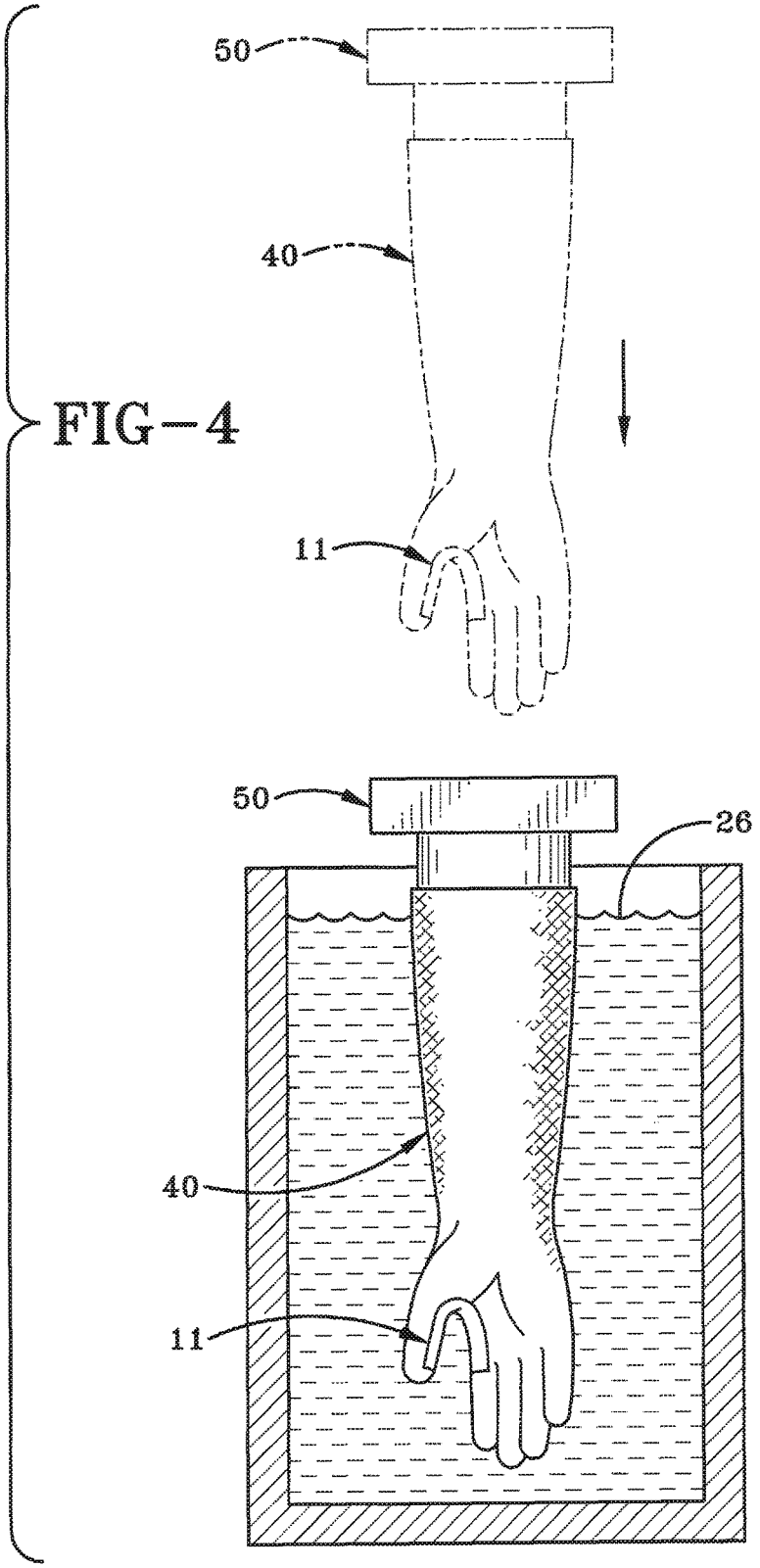
FIG. 4 is an operational view of the liner being dipped into a liquid solution that cures into a liquid proof and heat resistant outer surface of a glove.

As depicted in FIG. 4, the formation of protective device 10 is presented. Protective device 10 is formed by fitting liner 40 having protective member 11 adhered thereto, onto a former 42. Former 42 is shaped complementary to the completed glove or mitten shape of device 10. The liner 40 and member 11 are then dipped into a liquid. The liquid forms outer surface 26 of glove 12 when cured. The cured liquid defining outer surface 26 is liquid proof (i.e. hot grease) and heat resistant allowing device 10 to be used in association with high temperature cooking scenarios that involve contacting extremely hot liquids (i.e., in excess of 500° F.) and extremely sharp objects (i.e., a rotisserie spit). Protective member 11 is intermediate and sandwiched between the inner liner 40 and the outer skin 26 positioned in the thumb webbing region. Protective member 11 formed from a different material than the inner line 40 and from a different material than the outer skin 26.

Figure 5:
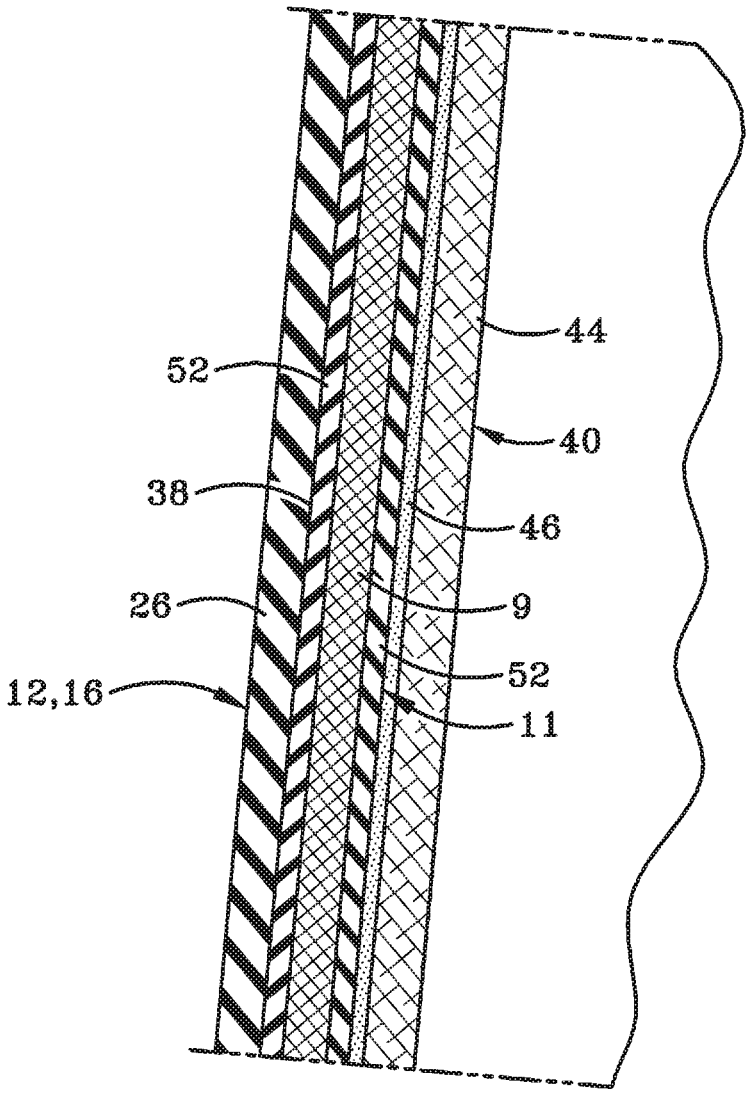
FIG. 5 is a cross section taken along line 5-5 in FIG. 1 depicting the assemble layers of materials integral to the thumb webbing region of the protective device of the present invention.

As depicted in FIG. 5, one embodiment of the present invention provides an outer layer 52 surrounding Kevlar cut resistant layer 9 on protective member 11. Outer layer 52 may cover both the upper surface and lower surface of layer 9 on protective member 11. Layer member 52 covering a first side of the protective member 11 disposed closely adjacent the outer surface 26 of glove 12. Additionally, the layer member 52 may entirely cover protective member 11, wherein the portion of layer 52 covering a second side of the protective member 11 is disposed closely adjacent the liner 40. In one exemplary non-limiting embodiment, layer member 52 is a material selected from a group comprising neoprene, polychloroprene, and synthetic rubber. Layer 52 encapsulates Kevalar layer 9 of protective member 11 in a manner that assists in the adhesive bonding with liner 40 as well as with outer surface 26, amongst other things.

As depicted throughout FIG. 1 through FIG. 5, the liner 40 is shaped as a glove, wherein the liner 40 is formed from a first material (see material hatching in FIG. 5). The finger receiving first sleeve 14 is defined by the connected liner 40 and outer skin (outer surface 26). The thumb receiving second sleeve 14 is defined by the connected liner 40 and the outer skin (outer surface 26). The integral protective member 11 is located intermediate the liner 40 and the outer skin (outer surface 26) positioned in the thumb webbing region 22 formed of a third material different than the first material of the liner and the second material of the outer skin (please refer to the hatching designations of FIG. 5 in cross section to clearly identify the three different materials forming liner 40, outer skin 26, and protective member 11). The third material of the protective member 11 may be selected from a group comprising a para-aramid synthetic fiber and an aramid synthetic fiber. The glove 12 has a palmar region and a back region, wherein the first edge 32 of protective member 11 is disposed in the palmar region (on the palm side) and the second edge 34 is disposed in the back region (on the back side of the hand). As indicated above, the second material forming the outer surface 26 withstands melting and does not ignite at temperatures of 500° Fahrenheit.

In accordance with one aspect of the present invention described above, protective device 10 is configured to protect a user's hand in when exposed to high temperatures, hot liquids, and sharp objects. The protective device includes an integrally formed protective member 11 inside (i.e., between layers) the device 10 and this may be advantageous as member 11 protects webbing region 22 without the need for adding an additional protective member that is a distinct or separate piece.

Figure 3:
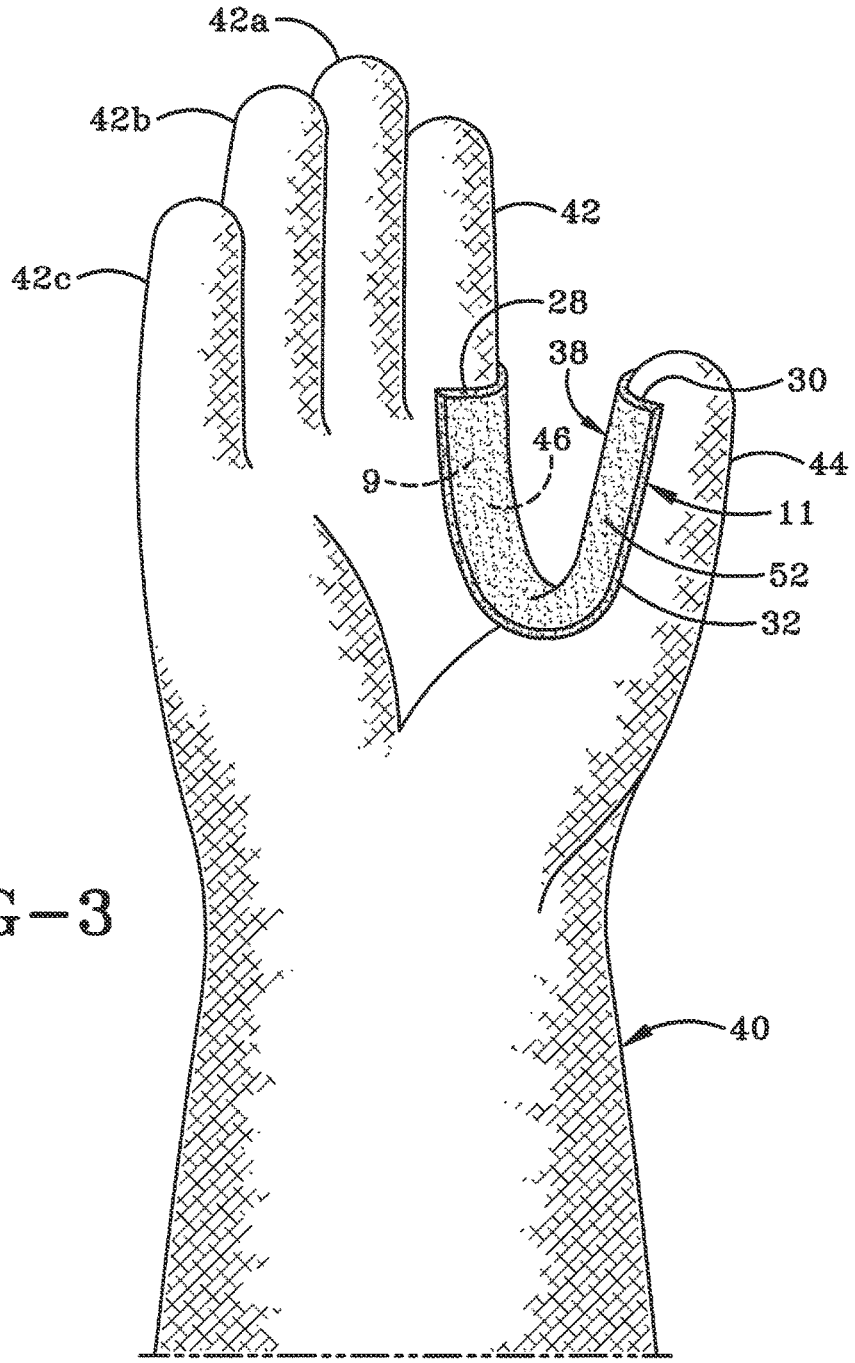
FIG. 3 is an assembled view of the protective member attached to the liner in a thumb webbing region or crotch.

In operation and with reference to FIG. 2, protective member 11 is shown pre-coated with layer 52. It is understood that coating protective member 11, made from Kevlar 9, with layer 53, made from neoprene, may be accomplished in a variety of known ways, such as adhesives or thermowelding, amongst many others. Protective member 11 coated with layer 52 is adhered to liner 40 in webbing region 22 with adhesive 46. The configuration with protective member 11 adhered to liner 40 is represented in FIG. 3.

In operation and with reference to FIG. 4, liner 40 having attached member 11 are fitted onto a former 50. The former 50 carrying liner 40 is dipped or submerged into a liquid. The liquid attaches to liner 40 and outer layer 52. The former 50 is then removed from the liquid and the liquid attached to liner 40 is allowed to cure. When the liquid cures, the cured liquid forms skin 26 of glove 12 which is liquid proof and heat resistance and configured to protect a workman's hands in high heat applications.

With protective member 11 integrally formed between outer surface 26 of glove 12 and liner 40 to define device 10, the device 10 is ready for use. In use, a rotisserie spit or other elongated hot or sharp member is grasped by a workman. Preferably, the spit has cooked chickens speared through and attached to the spit. The workman grasps the spit, by engaging the thumb webbing region with the spit and wrapping their fingers and thumb around the spit. Ordinarily, a right handed person grasps the right end of the spit with their right hand and grasps adjacent the right end of the spit with his left hand in the glove. The user then pulls the spit using his right hand in a motion similar to drawing a sword, all while continuing to grasp the spit with his left hand. As the spit travels through the user's grasped hand, the chickens are released from the spit and fall into a desired container. Clearly, the motion described above could be reversed for left handed individuals.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

What is claimed:

1. A liquid proof and heat resistant protective device worn on a hand comprising:

an inner liner shaped as a glove, wherein the inner liner is formed from a first material;

an outer skin connected to the inner liner defining an outer surface of the glove, wherein the outer skin is formed from a second material different than the first material, and the second material is liquid proof and withstands thermal deformation and ignition at temperatures of 500 degrees Fahrenheit;

a finger receiving first sleeve defined by the inner liner and outer skin connected together;

a thumb receiving second sleeve defined by the inner liner and outer skin connected together;

a thumb webbing region defined between the first and second sleeve; and an impermeable integral protective member intermediate and sandwiched between the inner liner and outer skin positioned in the thumb webbing region formed of a third material different than the first material of the inner liner and the second material of the outer skin, wherein the protective member is positioned entirely beneath the outer skin such that the protective member is not viewable when looking at the outer skin of the glove, wherein the impermeable integral protective member prevents the outer skin from striking therethrough when forming the outer skin by dipping the inner liner and protective member therein.

2. The protective device of claim 1, further comprising:

a layer member covering a first side of the protective member adjacent and interior to the outer skin.

3. The protective device of claim 2, further comprising:

wherein the layer member covers a second side of the protective member and is disposed adjacent the inner liner, so as to entirely cover the protective member.

4. The protective device of claim 3, wherein the layer member is a material selected from a group comprising neoprene, polychloroprene, and synthetic rubber.

5. The protective device of claim 1, further comprising:

a base opposite a tip end of the first sleeve; and a first end of the protective member positioned above the inner liner adjacent the base of the first sleeve, wherein the first end of the protective member is C-shaped in cross section so as to allow the first end of the protective member to partially wrap around the inner liner in the first sleeve.

6. The protective device of claim 5, further comprising:

a base opposite a tip end of the second sleeve; and a second end of the protective member positioned above the inner liner disposed between the base and tip end of the second sleeve, wherein the second end of the protective member is C-shaped in cross section so as to allow the second end of the protective member to partially wrap around the inner liner in the second sleeve.

7. The protective device of claim 6, wherein the second end of the protective member is adjacent the tip end of the second sleeve.

8. The protective device of claim 1, further comprising:

a first edge and a second edge on the protective member;

a palmar region of the inner liner and connected outer skin shaped as the glove opposite a back region of the inner liner and outer skin shaped as the glove;

wherein the first edge is disposed in the palmar region and the second edge is disposed in the back region.

9. The protective device of claim 1, further comprising:

a U-shaped configuration of the protective member when viewed from the side, wherein the protective member terminates short of an end tip on the first and second sleeves.

10. The protective device of claim 8, wherein a surface of the protective member extends arcuately over the thumb webbing region between the first edge and the second edge.

11. The protective device of claim 1, further comprising:

an adhesive securing the protective member to the inner liner.

12. The protective device of claim 1, wherein the thumb webbing region defined between the finger receiving first sleeve and the thumb receiving second sleeve is J-shaped when viewed from a palmar side of the glove and the protective member is shaped complementary to the webbing region and covers a portion of the palmar region and a portion of the dorsal region of the glove.

13. The protective device of claim 1, further comprising a raised portion of the outer skin, wherein the protective member is positioned below the raised portion configured to allow the protective member to be detectable to a touch of a user.

14. The protective device of claim 1, wherein the protective member is C-shaped in cross section.

15. The protective device of claim 8, wherein the protective member disposed intermediate the outer skin and the inner liner further comprises:

a first end opposite a second end of the protective member, wherein the first edge is arcuate between the first end and the second end.

* * * * *